US009947275B1

(12) United States Patent
Ramanath et al.

(10) Patent No.: US 9,947,275 B1
(45) Date of Patent: Apr. 17, 2018

(54) REAL-TIME WHITE POINT CORRECTION FOR TABLET DISPLAY

(71) Applicant: Amazon Technologies, Inc., Seattle, WA (US)

(72) Inventors: Rajeev Ramanath, San Jose, CA (US); Ajay Gowribdanur Ramesh, San Jose, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 444 days.

(21) Appl. No.: 14/574,285

(22) Filed: Dec. 17, 2014

Related U.S. Application Data

(60) Provisional application No. 62/053,040, filed on Sep. 19, 2014.

(51) Int. Cl.
*G09G 5/10* (2006.01)
*G09G 3/34* (2006.01)

(52) U.S. Cl.
CPC ... *G09G 3/3413* (2013.01); *G09G 2320/0666* (2013.01); *G09G 2360/144* (2013.01); *G09G 2360/145* (2013.01)

(58) Field of Classification Search
CPC ..... G09G 5/10; G09G 3/2003
USPC ..... 345/207, 102, 82
See application file for complete search history.

(56) References Cited

U.S. PATENT DOCUMENTS

2015/0070337 A1* 3/2015 Bell ..... G09G 3/2003 345/207

* cited by examiner

*Primary Examiner* — Carolyn R Edwards
(74) *Attorney, Agent, or Firm* — Davis Wright Tremaine LLP

(57) ABSTRACT

A method and apparatus are explained for performing white point color adjustment for a display device. This can be done by obtaining a value of an ambient light sensor, determining whether to make a white point adjustment, and, for a dynamic white point adjustment, using the value from the ambient light sensor in performing white point adjustment toward target color coordinates. A white point might be set equal to the target color coordinates, but might also remain unchanged for small ambient light changes or ambient light outside a region of interest. The white point might be changed to the target color coordinates in multiple steps. Various parameters might be used that can be varied to vary behavior of the white point adjustment.

20 Claims, 12 Drawing Sheets

| | | CIE 1931 2° | | CIE 1964 10° | | |
|---|---|---|---|---|---|---|
| Common Label | Type of Illuminant | x2 | y2 | x10 | y10 | CCT (K) |
| A | Incandescent / Tungsten | 0.44757 | 0.40745 | 0.45117 | 0.40594 | 2856 |
| D50 | Horizon Light. ICC profile PCS | 0.34567 | 0.35850 | 0.34773 | 0.35952 | 5003 |
| D55 | Mid-morning / Mid-afternoon Daylight | 0.33242 | 0.34743 | 0.33411 | 0.34877 | 5503 |
| D65 | Noon Daylight: TV, sRGB color space | 0.31271 | 0.32902 | 0.31382 | 0.33100 | 6504 |
| D75 | North sky Daylight | 0.29902 | 0.31485 | 0.29968 | 0.31740 | 7504 |
| E | Equal energy | 0.33333 | 0.33333 | 0.33333 | 0.33333 | 5454 |
| F1 | Daylight Fluorescent | 0.31310 | 0.33727 | 0.31811 | 0.33559 | 6430 |
| F2 | Cool White Fluorescent | 0.37208 | 0.37529 | 0.37925 | 0.36733 | 4230 |
| F3 | White Fluorescent | 0.40910 | 0.39430 | 0.41761 | 0.38324 | 3450 |
| F4 | Warm White Fluorescent | 0.44018 | 0.40329 | 0.44920 | 0.39074 | 2940 |
| F5 | Daylight Fluorescent | 0.31379 | 0.34531 | 0.31975 | 0.34246 | 6350 |
| F6 | Lite White Fluorescent | 0.37790 | 0.38835 | 0.38660 | 0.37847 | 4150 |
| F7 | D65 simulator, Daylight simulator | 0.31292 | 0.32933 | 0.31569 | 0.32960 | 6500 |
| F8 | D50 simulator, Sylvania F40 Design 50 | 0.34588 | 0.35875 | 0.34902 | 0.35939 | 5000 |
| F9 | Cool White Deluxe Fluorescent | 0.37417 | 0.37281 | 0.37829 | 0.37045 | 4150 |
| F10 | Philips TL85, Ultralume 50 | 0.34609 | 0.35986 | 0.35090 | 0.35444 | 5000 |
| F11 | Philips TL84, Ultralume 40 | 0.38052 | 0.37713 | 0.38541 | 0.37123 | 4000 |
| F12 | Philips TL83, Ultralume 30 | 0.43695 | 0.40441 | 0.44256 | 0.39717 | 3000 |

FIG. 2 (prior art)

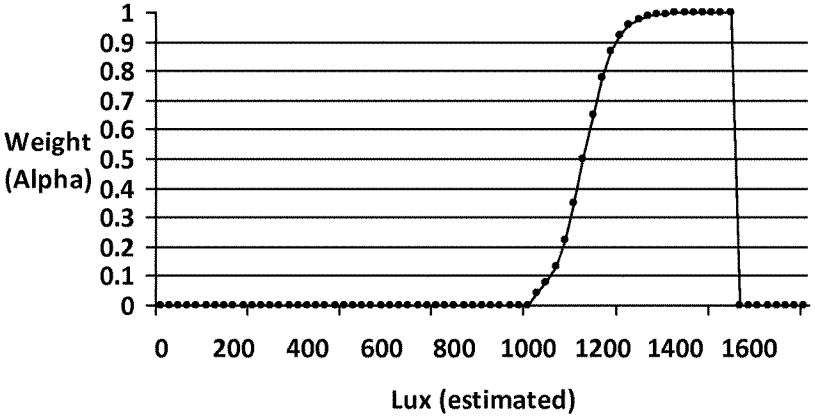
FIG. 10(A)
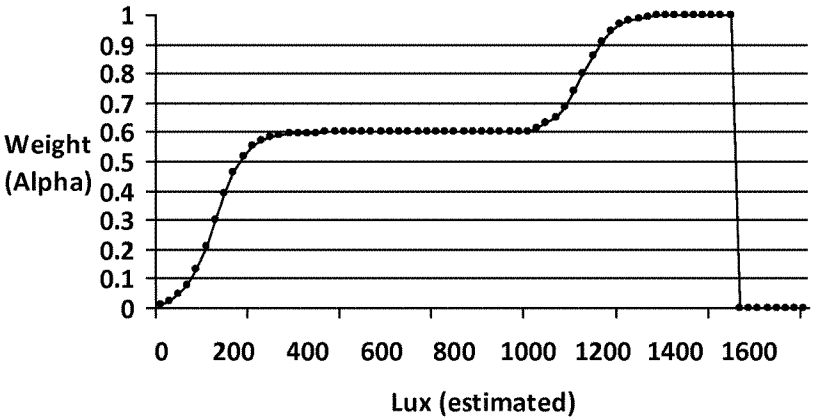
FIG. 10(B)
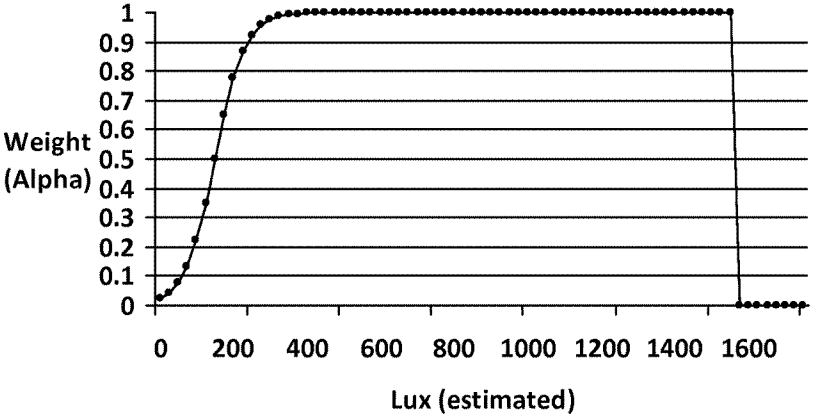
FIG. 10(C)
FIG. 10

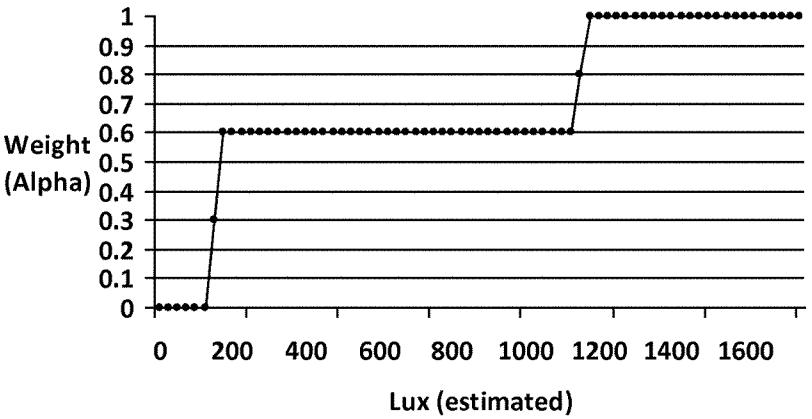
FIG. 11(A)
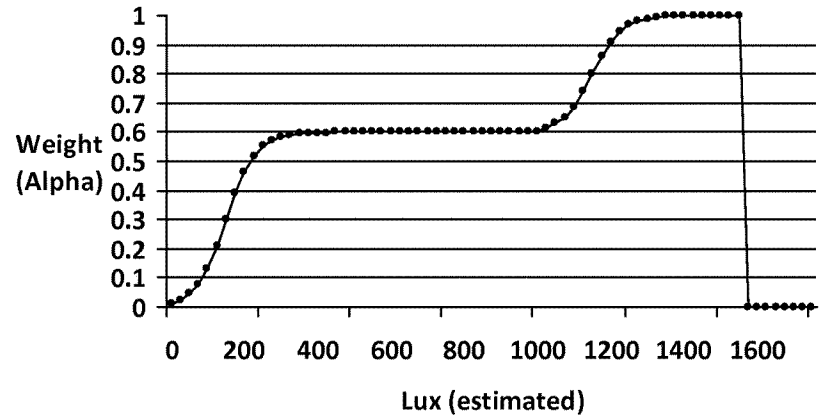
FIG. 11(B)
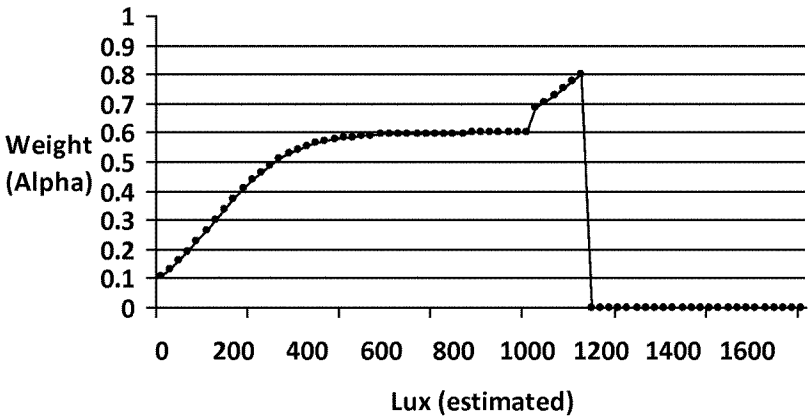
FIG. 11(C)
FIG. 11

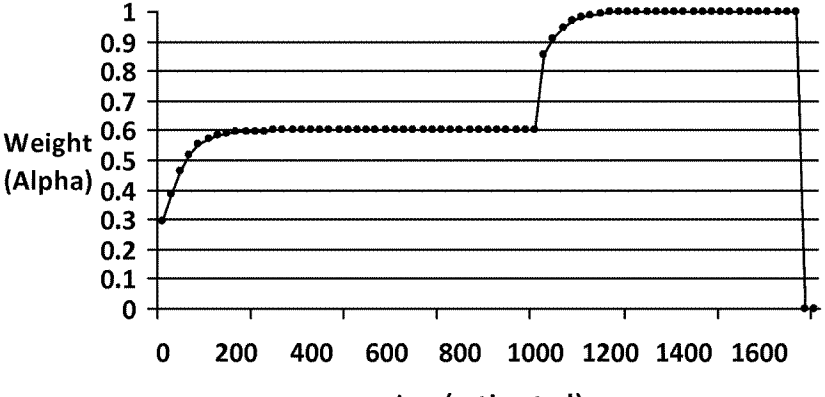
FIG. 12(A)
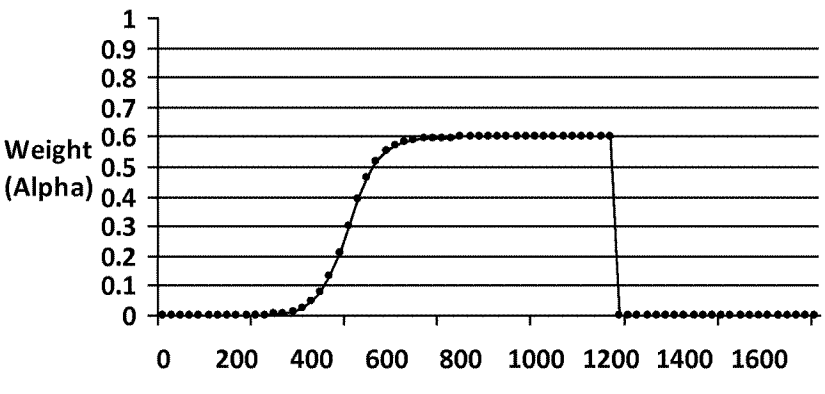
FIG. 12(B)
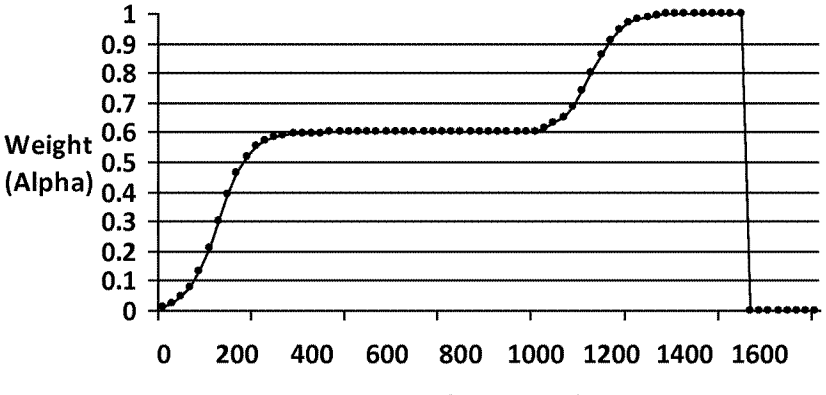
FIG. 12(C)
FIG. 12

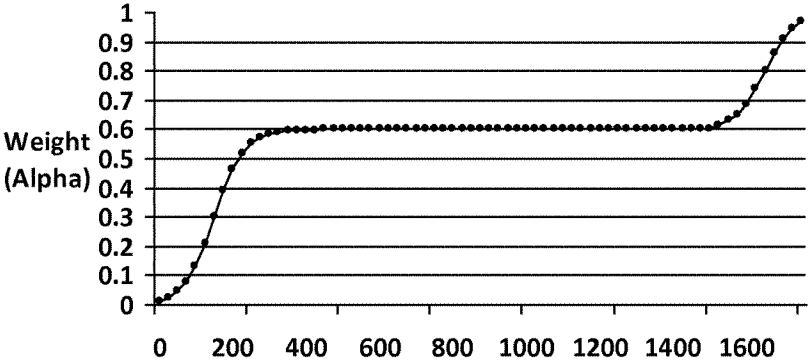
FIG. 13(C)
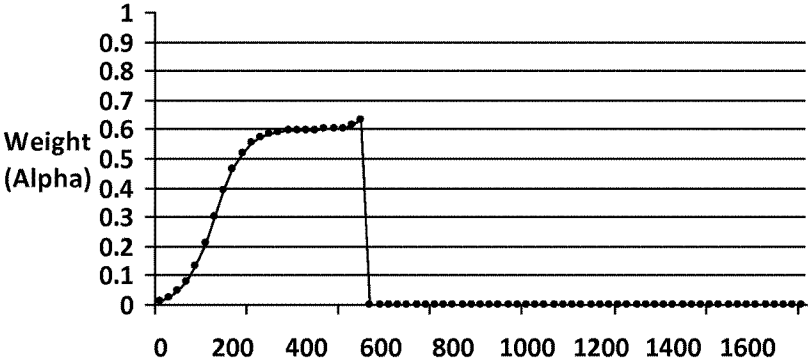
FIG. 13(A)
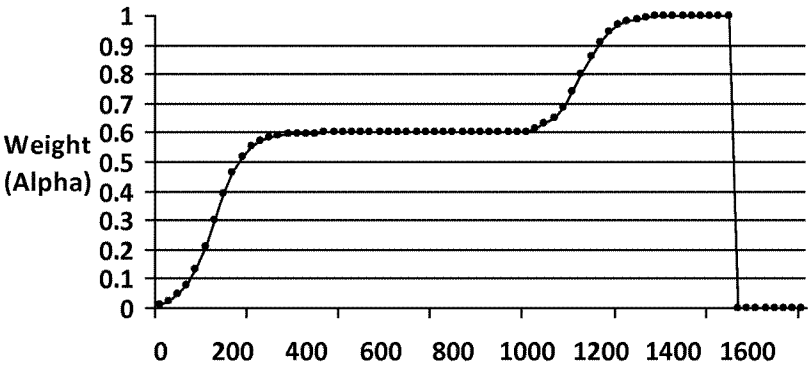
FIG. 13(B)
FIG. 13

REAL-TIME WHITE POINT CORRECTION FOR TABLET DISPLAY

BACKGROUND

Computer displays can be used for a wide variety of tasks, some of which involve long periods of users viewing a display. This can lead to eye strain and other physiological effects if viewing considerations are not taken into account. Some display functions that make extended viewing of the screen hard are apparent, such as a flickering screen, reading green text on a bright pink background, etc. However, there are some others that are more subtle.

With reflective displays, ambient light impinges on the display surface and is reflected off of a back plane of the display while some of the impinging light is absorbed by display elements, thus creating the image being displayed (which can be an image comprising text, pixels, lines, etc.). With emissive displays, the display supplies the light source and the display elements block some of the light, thus creating the image being displayed. Viewing a sheet of paper having an image thereon is more like reflective displays, in that the display (the paper) does not generate its own light, but reflects ambient light. Physiologically, many viewers will perceive a sheet of white paper with black lettering as being white regardless of the color of the ambient light (within limits). In some cases, it might be desirable to have similar effects with emissive displays.

BRIEF DESCRIPTION OF THE DRAWINGS

Various embodiments in accordance with the present disclosure will be described with reference to the drawings, in which:

FIG. 2 is a table of common illuminants and examples of their color values.

FIG. 10 comprises a set of plots 10(*a*), 10(*b*), and 10(*c*) illustrating effects on white point adjustment of varying a correction scale.

FIG. 11 comprises a set of plots 11(*a*), 11(*b*), and 11(*c*) illustrating effects on white point adjustment of varying a 50% point.

FIG. 12 comprises a set of plots 12(*a*), 12(*b*), and 12(*c*) illustrating effects on white point adjustment of varying a slope.

FIG. 13 comprises a set of plots 13(*a*), 13(*b*), and 13(*c*) illustrating effects on white point adjustment of varying a lux midpoint.

Figure 1:
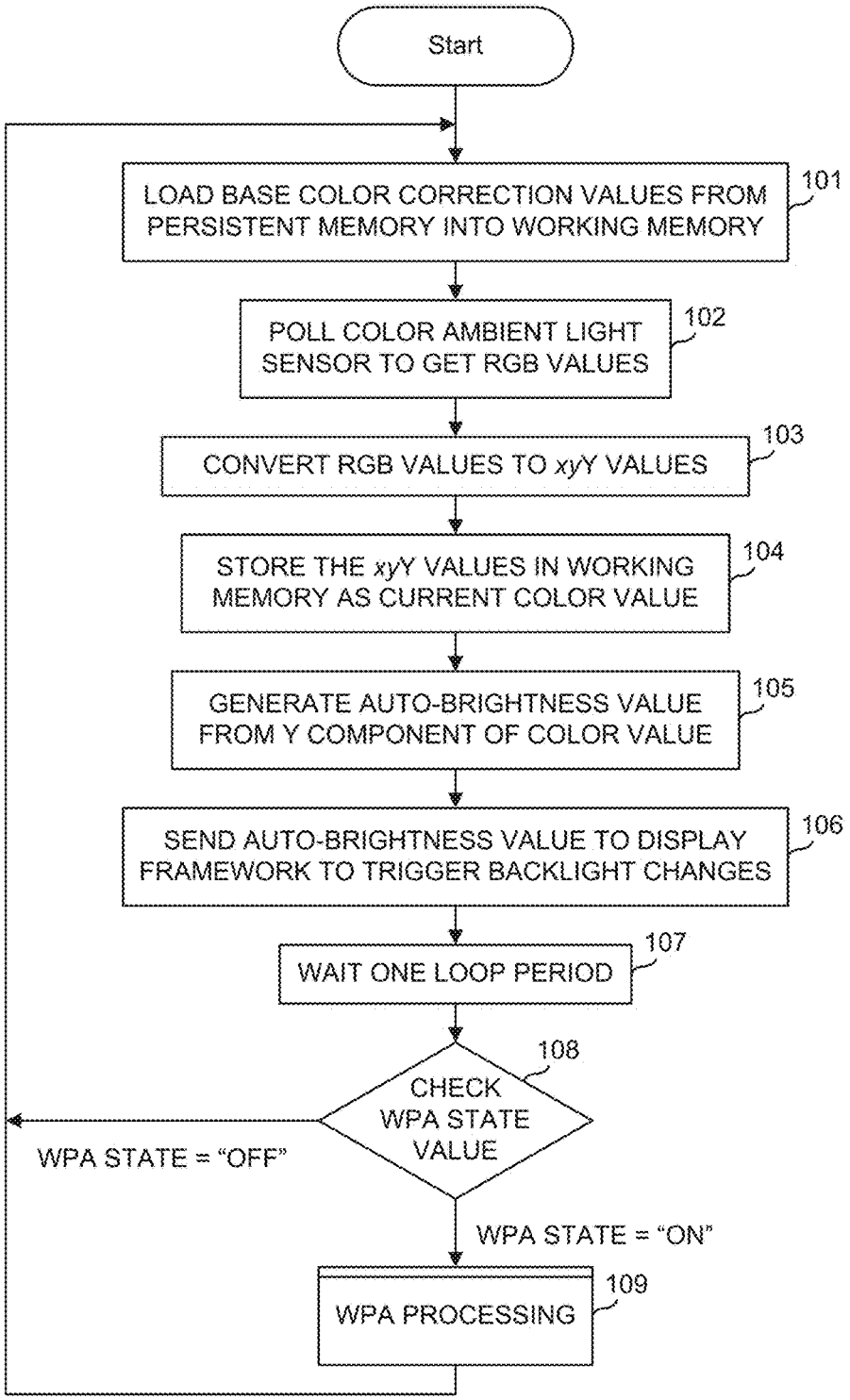
FIG. 1 is a flowchart of a white point adjustment process for an electronic device.

Appendix A provides an example of program code.

Appendix B provides an example of a set of calculations.

Appendix C provides another example of program code.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Ambient light detection is useful for displays that change some characteristics based on ambient light present around the display. Herein, methods and apparatus for dynamic light and color correction are presented. In a typical device having a display, the device has a color screen where the colors can be varied under software control. That device can have an ambient light sensor and an output of that ambient light sensor can be used by the software control to direct, instruct, and/or control the colors, gamut, palette, or other characteristics of the display. In specific examples, the output of that ambient light sensor can be used to set a color correction array that is used by various processes within the device to transform colors specified by an application, operating system, or other software running on the device into colors that are to be sent to display hardware for controlling display elements, such as pixel color values of pixels of the display. Herein, examples are provided and some of those examples are described with specific numerical values used for given parameters. In other variations, different values for those parameters might be used, as appropriate.

Techniques described and suggested herein include adjusting a white point for the display of a device according to the detected ambient light to correct for effects of different colors of ambient light. By adjusting the white point of the display, when display instructions are output from software, firmware or hardware on the device to color a display element to be white, the adjustment of the white point might result in the display instructions input to the display element to be different than the display instructions output from the software, firmware or hardware on the device, such that the display element appears to a viewer to be white under the detected ambient light even though the display element might not actually be white.

The ambient light can be determined using a color ambient light sensor ("CALS"). A white point adjustment process executed by a processor can be constrained so that the processor does not attempt to adjust the white point when the ambient light is outside a region of interest, does not attempt to adjust the white point for small variations in ambient light, and/or adjusts in steps for large variations in ambient light. A number of these operations can be parameter-driven, e.g., where the processes operate according to values that are modifiable, by a user, a manufacturer, a tester, or the like.

Using the methods and apparatus described herein, a device can perform real-time, or near real-time white point adjustment ("WPA") for a display using a color ambient light sensor. WPA is useful for displays that are stationary, but also for displays that are portable, such as tablet computers, and might frequently be moved from place to place thereby being used with varying ambient light sources. While the WPA implementation does not particularly limit its application to reading and printed matter, given that reading is by far the most common use case of "printed content on white background," reading applications are a natural place to find those WPA implementations. However, WPA can be applicable to other applications.

The white point of a piece of white paper can change. The human visual system is able to adapt to white points of a scene seamlessly in order to use a combination of various psychophysical phenomena and chromatic adaptation to maintain the perception of a piece of white paper as white, independent of the color of the light, within limits. In the presence on a single reference white, the human visual system is highly adept at adapting a new white point to maintain a consistent viewing experience. When presented with multiple "whites," some of which are emissive and some reflective, the human visual system tends to bias towards a reflective color model (the world around us) that is used by white paper, rather than an additive color model (most emissive displays).

FIG. 1 is a flowchart of a white point adjustment ("WPA") process performed by a device having a display. This process might be performed by a circuit that includes a processor of the display that executes instructions and might begin when the device is powered up. In this process, in step 101, the processor loads base color correction values from persistent memory into working memory. The persistent memory might be a flash memory or other memory that retains its contents without power being applied. As explained in more detail below, the base color correction values might be set during manufacturing (and thus serve as factory defaults for color correction). The persistent memory might also contain firmware, other factory defaults, and/or the like. The location in working memory for storing these base color correction values initially might be registers allocated for current sensed color coordinates. As explained below, there might also be a need for registers allocated for storage of previously sensed color coordinates, in which case in step 101 the registers allocated for previously sensed color coordinate values might be loaded with those same base color correction values.

For various operations, such as mathematical operations, on the color coordinates, the color coordinates can be represented by color coordinate values, which might be floating-point numbers. The registers allocated for sensed color coordinate values might comprise storage for three floating-point numbers. The registers allocated for previously sensed color coordinate values might comprise other storage for three floating-point numbers. In some configurations, the registers for those previously sensed color coordinate values might be set to some default or initializing value so that other routines operate as expected even when a previous light sensor reading is not available. To account for this, the contents of those registers might more generally be referred to as storage for previously stored color coordinate values and those values might correspond to color coordinates of actually sensed light color previously sensed in a prior adjustment period or default values that are not necessarily related to actually sensed light color.

In step 102, the processor can poll a color ambient light sensor ("CALS") to obtain a set of RGB values corresponding to the sensed color of ambient light. Instead of polling, pushing, or some other technique for obtaining sensor values from a sensor might be used. In step 103, the obtained RGB color signal is converted to "xyY" values in an "xyY" color space such as the conventional CIE xyY color space, as explained in more detail below. In step 104, those "xyY" values are stored in working memory in a register allocated for a current sensor reading for current sensed color coordinates. The registers allocated for the current sensed color coordinates might comprise storage for three floating-point numbers. In particular, those three floating-point numbers might correspond to the "x" component of the current sensed color coordinates, the "y" component of the current sensed color coordinates, and the "Y" component of the current sensed color coordinates, respectively.

In step 105, the processor can calculate an auto-brightness level from the Y component of the current sensed color coordinates. This might be done in a conventional manner and/or might use a lookup table for converting from a value of the Y component to an auto-brightness level. In a typical emissive display that is illuminated by a backlight, that overall brightness level might be varied by varying duty cycles of power applied to the backlight. In step 106, that auto-brightness level is communicated to a display framework of the device in order for that display framework to adjust an overall brightness level.

In step 107, the process waits for a loop period. The loop period can be selected based on power requirements, sensor speed, visual effects, or other considerations. Where performing the processing of steps 101 to 106 consumes battery power, the loop period need not be smaller than a visual reaction time of the typical user. In one example, where a sensor response time is 100 milliseconds, the loop period is 200 milliseconds. In that example, the loop period is not so slow that the device cannot timely respond to changes in ambient light color, but also not so fast that the CALS is polled more frequently than the CALS is able to update its sensor readings. This waiting or pausing can be done according to conventional techniques so that the processor is available for other tasks.

In step 108, the processor checks a stored WPA state value. If the stored WPA state value is "OFF" then the processor loops back to step 101 without performing WPA processing. Otherwise, if the stored WPA state value is "ON" then the processor executes WPA processing (step 109) before looping back to step 101. WPA processing is explained below in more detail and illustrated in FIG. 7.

Ambient light color (or other light color) can be characterized in a number of different ways. FIG. 2 illustrates some existing characterizations of light, including several different light colors that are sometimes referred to as "white" light. FIG. 2 provides a non-exhaustive list of some common illuminants and examples of their color values in three color spaces. For each of these example illuminants, the color of their light (their "white point") is expressed as International Commission on Illumination ("CIE") (x, y) 2° values ("CIE 1931 2°" values), CIE 1964 10° values, and also as Correlated Color Temperature ("CCT") values. Each of those color spaces is well-known and so their details need not be laid out here. Typically, in designing devices, lighting or otherwise dealing with light color, one color space is used consistently throughout. In the examples herein, the CIE 1931 2° color values are used by way of explanation.

Figure 3:
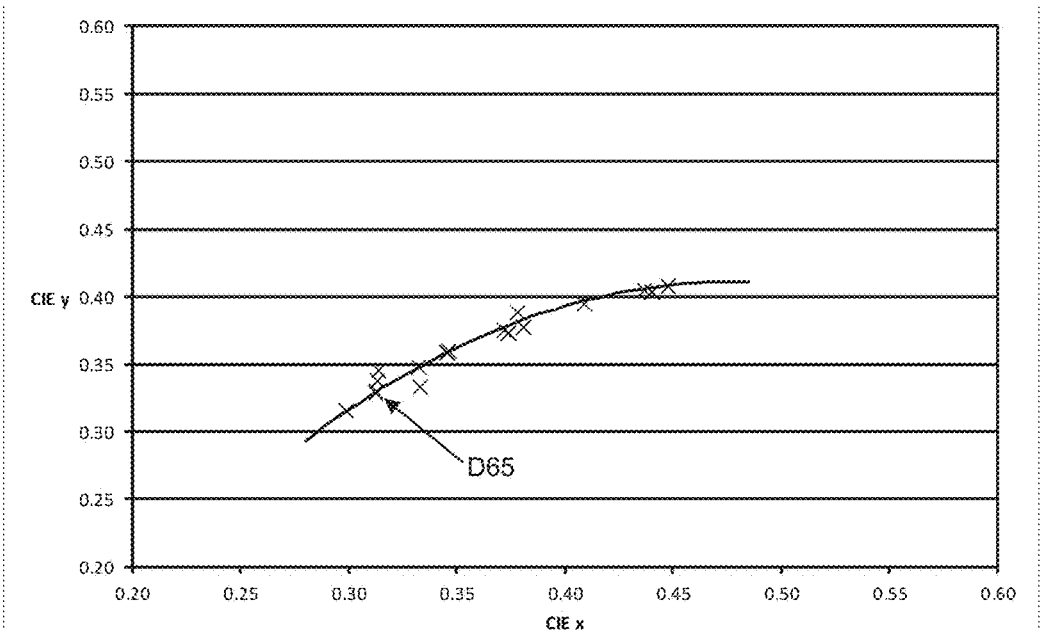
FIG. 3 (prior art)
FIG. 3 is a scatter plot of the color values of FIG. 2.

FIG. 3 is a scatter plot of the CIE 1931 2° color values from that table of FIG. 2. As illustrated there, the color of "white" light can vary depending on the light source. One of the CIE 1931 2° color values, often referred to as F7, D65, Daylight Simulator, or CIE Standard Daylight Illuminant, is indicated by the arrow in FIG. 3. A common approach to dealing with ambient light effects is to assume that ambient light has the D65 color. As a result, D65 has become an industry standard white point so that content is designed with D65 assumed as the white point. However, as shown by FIG. 3, D65 is biased significantly to the lower-left (the "bluer" side) of the color space relative to other illuminants, such as Illuminant A (common incandescent lamp) and F12 (arguably the most common office lighting illuminant). These white points show significant amount of variation in a colorimetric space. By adapting to the white point of the actually present ambient light, a more comfortable reading experience might be enjoyed.

Also shown in FIG. 3 is a curve that is known as the CIE daylight locus. That curve can be used as an indication of points in the CIE (x, y) color space that correspond to what a human eye might perceive as daylight. Those points in CIE (x, y) color space are sometimes approximated with the quadratic curve defined by $y=-3.000x^2+2.870x-0.275$.

Figure 4:
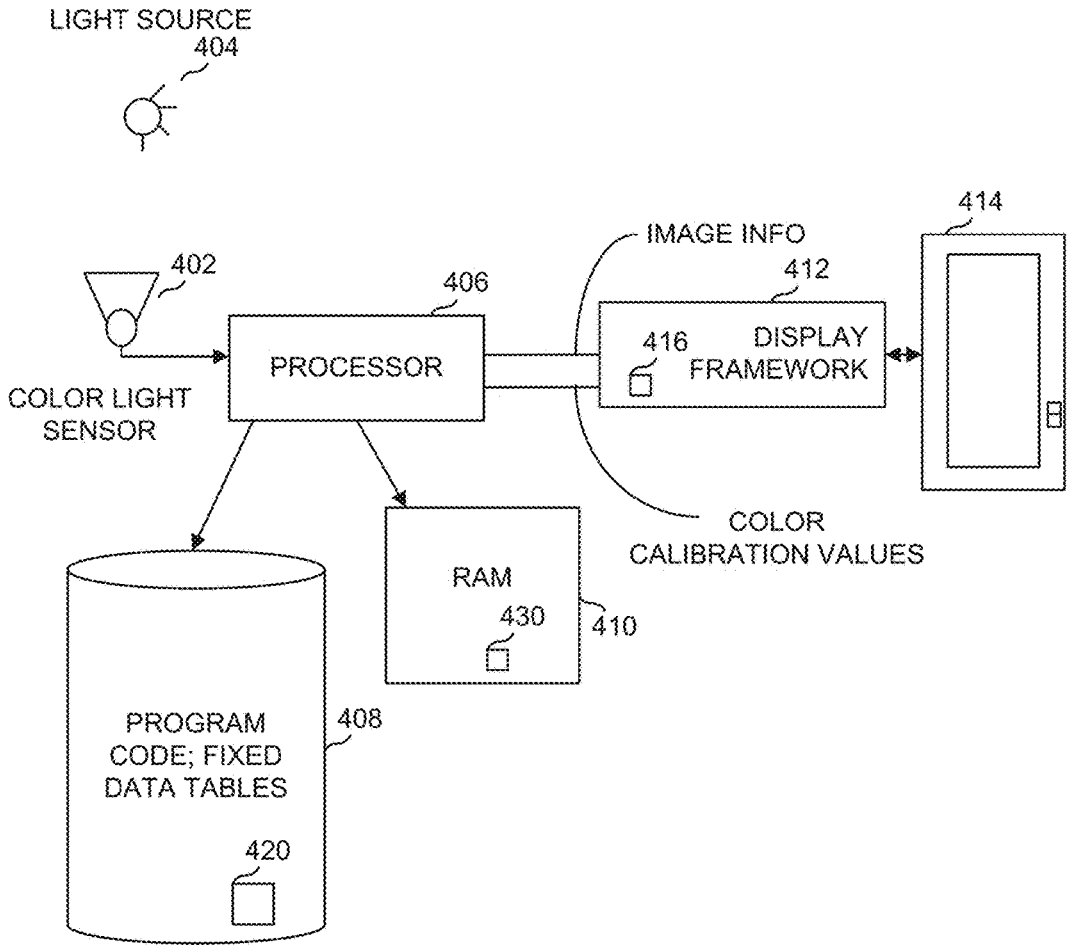
FIG. 4 is a block diagram of some of the components of a device that might use the white point adjustment process of FIG. 1.

FIG. 4 is a block diagram of some of the components of a device that might perform the process described in FIG. 1 to adjust the white point of a display of that device. As illustrated there, a color light sensor 402 senses light from a light source 404. Since it is a color light sensor, it can output signals representative of more than one wavelength of light, typically three (such as red/green/blue, referred to as "RGB"). Those signals are provided to a processor 406. Processor 406 is coupled to storage 408, which might be flash memory or other type of persistent memory (e.g., memory where memory contents are retained through a power cycling). Storage 408 contains program code that processor 406 executes to perform various functions, such as those operations, processes, methods and functions described herein. The program code might include instructions to perform processes described elsewhere herein, as well as other functions for which a processor might be used. Storage 408 also contains data structures that are relatively fixed.

Processor 406 is shown coupled to a display framework 412, which might be implemented by operating system level calls. However, display framework 412 is implemented, it controls a display 414 to display images as directed by processor 406 using a white point setting provided to display framework 412. In a specific example, the white point setting is used in setting color matrix values stored in color matrix registers 416, as explained in more detail below.

Processor 406 is also coupled to RAM 410 for storage of data, variables and other volatile memory storage. Registers for specific data structures or values might be also provided, either volatile or persistent. Storage 408 might also have data storage 420 for persistent values for the RBG2XYZ[ ] matrix, the base "black" sensor readings, and a setting for the WPA state. RAM 410 might have memory allocated for a register set called XY_PAST and a register set called XY_CURRENT, each of which might comprise storage for two floating point numbers, the use of which is explained elsewhere herein.

In some variations, RAM 410 has allocated memory for a WPA state value that is initially copied from the persistent memory setting for the WPA state and can change under software and/or hardware control. For example, some devices might be configured with a factory default setting having the WPA state be set to "ON", signaling that WPA is to be performed with the device, but software settings might allow for a manufacturer or user to disable WPA by setting the WPA state in RAM to "OFF".

Figure 5:
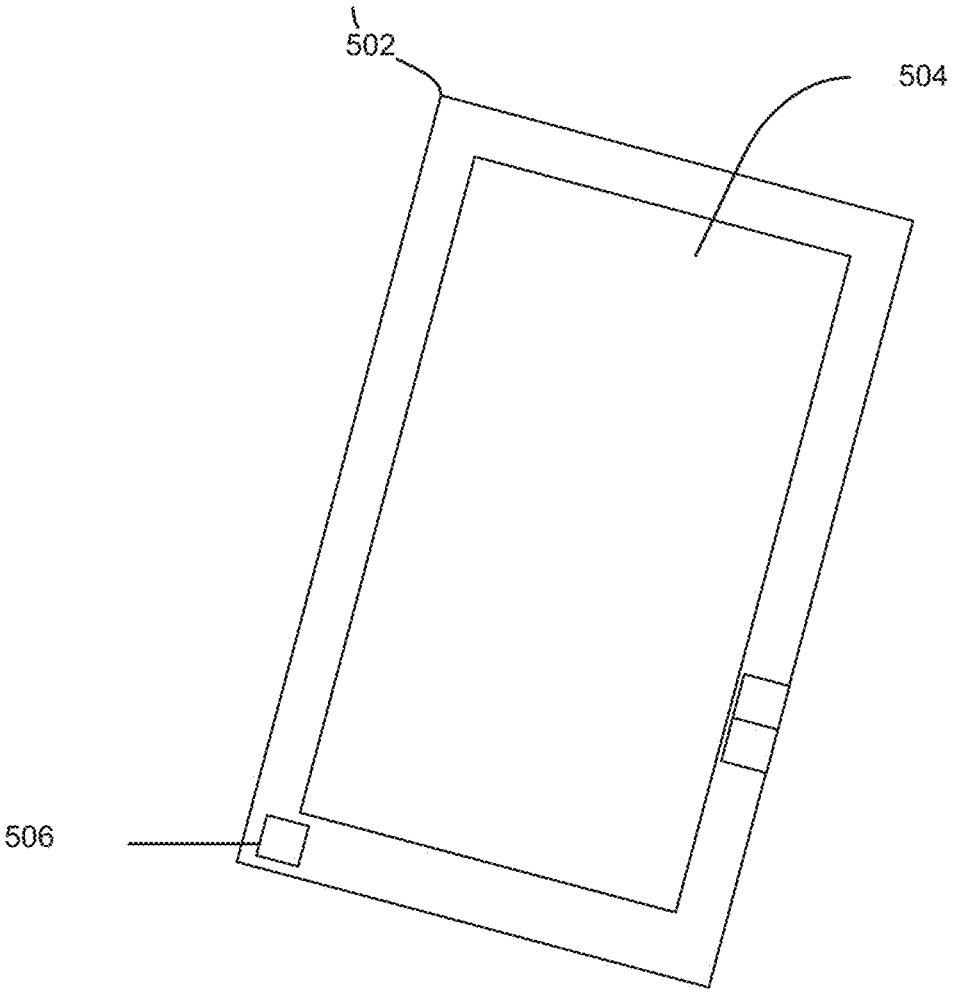
FIG. 5 illustrates a tablet computer having an emissive display and a color ambient light sensor, as might be used with the techniques and apparatus described herein.

FIG. 5 illustrates a tablet computer 502 having an emissive color display 504 and a color ambient light sensor ("CALS") 506. Such a tablet computer might include various features such as wired or wireless communication, ability to read books, play games, run applications, organize information, communicate, and/or the like. User inputs might include a touch-sensitive screen, buttons, wireless inputs or other inputs. While CALS 506 is shown in the lower left of the front face of the tablet, in other examples CALS 506 might be located in other positions on tablet computer 502. Tablet computer 502 might include an application processor (not shown) and a system on a chip (also not shown) that has a color calibration block for handling color correction. With such hardware, the WPA processes described herein might adapt the white point of the display using the color calibration block.

Figure 6:
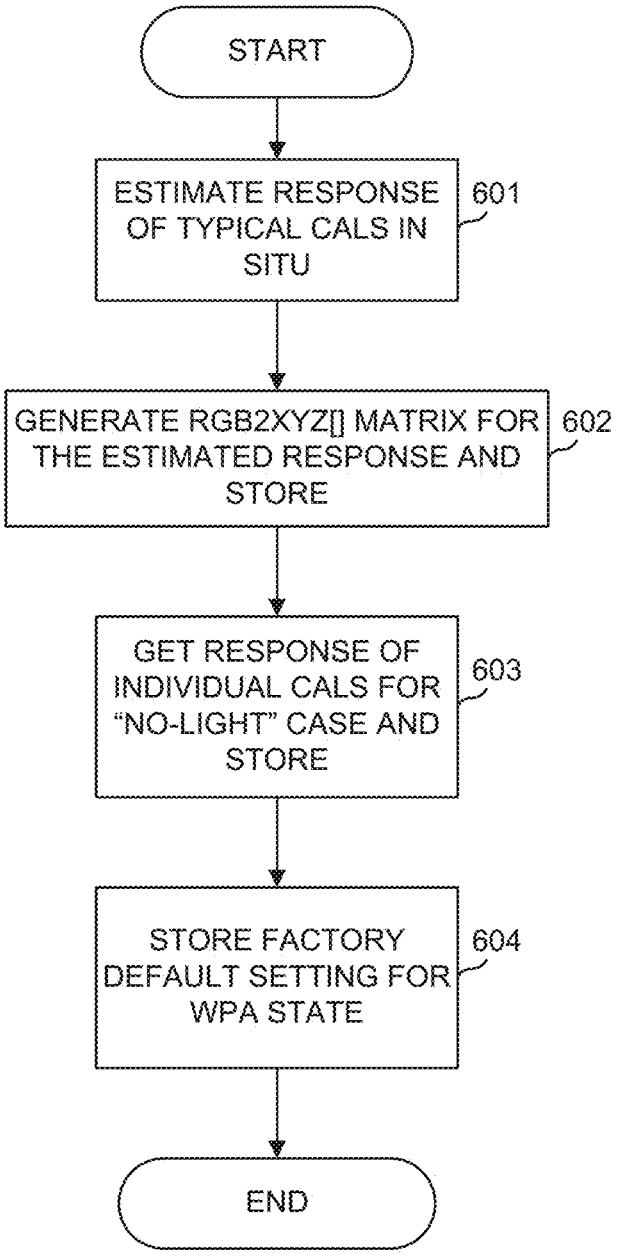
FIG. 6 is a flowchart of a manufacturing process to generate certain factory settings used in the tablet computer.

FIGS. 1 and 4 reference a matrix RGB2XYZ[ ]. The values in this matrix might be set as factory settings in a device that performs WPA. FIG. 6 is a flowchart of an initialization process to generate certain factory settings for the device. Some of the factory settings might be specific to a specific device based on performance response of the particular components used in that specific device, while other factory settings might be the same for a large number of devices regardless of the manufacturing variations of their particular components. In either case, these factory settings might be stored as is conventionally known, in persistent memory of a device to be read when the device is reset to factory state, when the device is powered up, or for other initializing conditions.

For example, each individual device having a CALS might be programmed with a factory setting representing a "no light" reading from that individual device's CALS, which can be easily obtained by running a process during a factory acceptance test procedure ("FATP") in the absence of light impinging on that CALS. The factory acceptance test procedure could involve recording the CALS response under various controlled ambient light conditions, to capture each individual device's variations that might be caused by manufacturing variations in the CALS itself, a cover glass covering the CALS and other manufacturing variations. However, calibrating each device to its response to various ambient light sources might not be practical. In such cases, the factory settings for each device might be set based not on that device's own response, but the response recorded in a test of a small representative sample of devices, or even one representative device. Thus, each device might have memory storage for preset parameters that are derived from manufacturing or operating characteristics of a representative set of devices and memory storage for individual device parameters that are derived from manufacturing or operating characteristics of that specific electronic device.

FIG. 6 illustrates that type of factory default setting, with some settings being specific to an individual device and some being representative of a group of devices, ranging from all devices of a particular production run, all devices of a particular model number, or some other grouping of devices. In step 601, the response of a typical CALS in situ is estimated. The respond might simply be the RGB readings from the CALS under various ambient light settings. This might be done by testing a few dozen production samples, eliminating outliers, and averaging the remaining ones to arrive at what will be deemed the typical readings. These steps can be performed by a testing rig, a tablet device being tested, or otherwise.

Then, in step 602, the RGB2XYZ[ ] matrix, explained below, is generated for the estimated response of the typical CALS and stored in persistent memory of the device. The matrix calculation can be done by a FATP processor and need not be done on the device. In step 603, the individual device "no light" reading of that device is obtained and stored in persistent memory of the device. Herein, the "no light" readings for a device are represented by the variable array (Rk, Gk, Bk). In step 604, a factory default setting for the WPA state can also be stored in persistent memory. Example factory default settings are "ON" indicating that WPA is performed by default, and "OFF" indicating that WPA is not performed, unless the WPA state is later changed to "ON".

In one example, the matrix RGB2XYZ[ ] might comprise the values shown in Equation 1, stored on each device at the factory. The numbers in the RGB2XYZ[ ] are unitless, since the RGB values and the XYZ values are unitless. The XYZ values can be conventional CIE XYZ color space values. In some RGB spaces, each of the R, G, and B values are integers ranging from 0 to 255.

$$RGB2XYZ[\,] = \begin{bmatrix} 0.069198845 & 0.030669405 & 0.06106953 \\ 0.059971194 & 0.020108799 & 0.134354327 \\ -0.011755611 & -0.011316817 & 0.392743144 \end{bmatrix} \quad \text{(Eqn. 1)}$$

A color space transform matrix, A, can be calculated and used as a factory default, since its values only depend on other factory default values. The color space transform matrix A is used in several processes, as described herein. The chromaticity coordinates of the display of a device are provided by a color points matrix. An example color points matrix might have the following values:

| | |
|---|---|
| xR = 0.646 | yR = 0.330 |
| xG = 0.297 | yG = 0.593 |
| xB = 0.151 | yB = 0.067 |
| xW = 0.313 | yW = 0.329 |

The chromaticity coordinates stored in a specific device might be numbers specific to that device, or specific to a group of devices that might be determined by a design choice, such as keeping the chromaticity coordinates the same for a period of time until a change is desired. From the color points matrix, a set of primary weights kR, kG, kB can be computed using Equation 2, where the superscript "−1" denotes a matrix inverse operation.

$$\begin{bmatrix} kR \\ kG \\ kB \end{bmatrix} = \begin{bmatrix} xR & xG & xB \\ yR & yG & yB \\ (1-xR-yR) & (1-xG-yG) & (1-xB-yB) \end{bmatrix}^{-1} \begin{bmatrix} \frac{xW}{yW} \\ 1 \\ \frac{1-xW-yW}{yW} \end{bmatrix} \quad \text{(Eqn. 2)}$$

From these primary weights kR, kG, kB, the color space transform matrix A is computed using Equation 3.

$$A = \begin{bmatrix} kR*xR & kG*xG & kB*xB \\ kR*yR & kG*yG & kB*yB \\ kR*zR & kG*zG & kB*zB \end{bmatrix} \quad \text{(Eqn. 3)}$$

The matrix inverse of color space transform matrix A, matrix $A^{-1}$, might also be calculated ahead of time. In some cases, color space transform matrix A is not needed once matrix $A^{-1}$ is calculated, so color space transform matrix A need not be stored on the device in those cases. An example of the matrix $A^{-1}$ is shown below in Equation 4. In some variations, associated fixed points of these coefficients are used based on specific implementation architecture.

$$A^{-1} = \begin{bmatrix} 3.197213032367973 & -1.510793781942079 & -0.487923253833050 \\ -0.968865784759543 & 1.894829038629370 & 0.024738091957191 \\ 0.082571786006733 & -0.239214220726049 & 1.066638294968611 \end{bmatrix} \quad \text{(Eqn. 4)}$$

Figure 7:
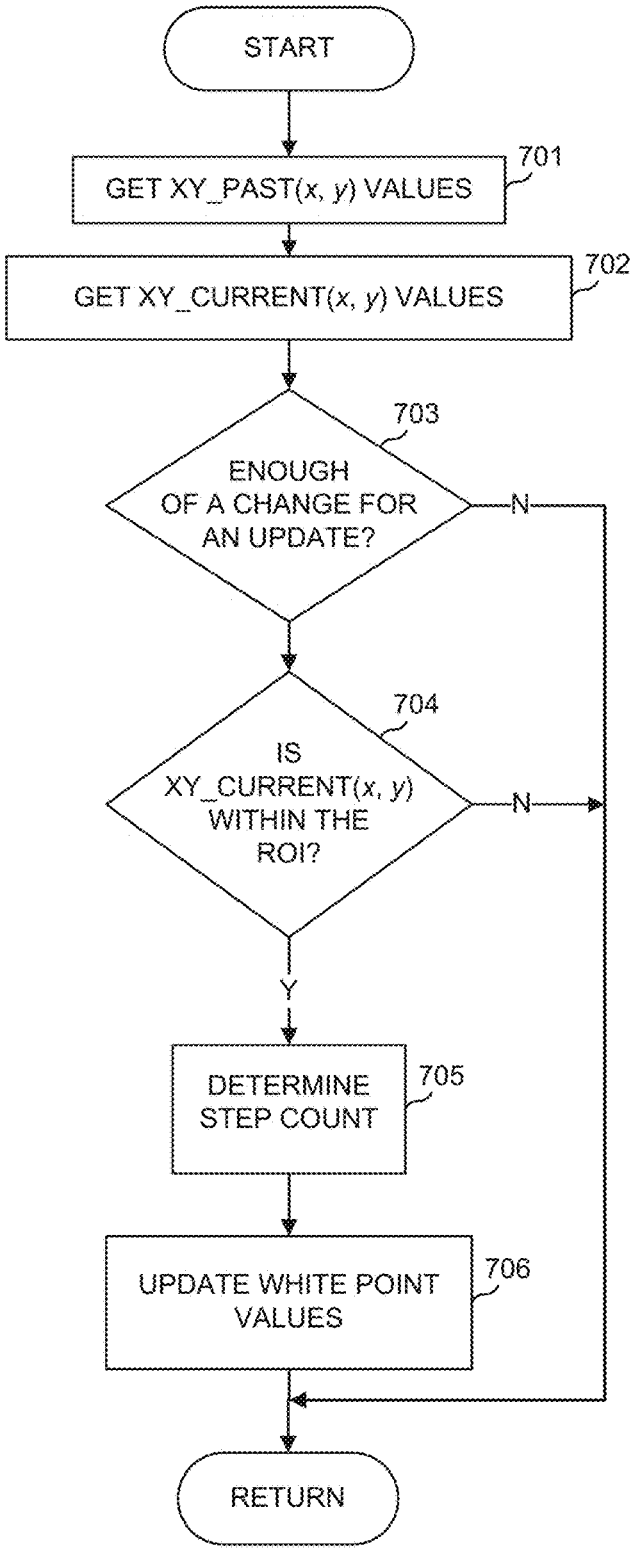
FIG. 7 is a flowchart of a subprocess for dynamic white point adjustment in greater detail.

FIG. 7 is a flowchart of a subprocess for white point adjustment in greater detail. This might be used in step 109 of the process shown in FIG. 1. In the general case, target color coordinates are determined and are used to set an adjusted white point. As explained elsewhere herein, a color correction matrix can be calculated for given color coordinates and provided to the display framework so that the display has the appropriate white point. In some cases, the target color coordinates are simply the current sensed color coordinates, while in other cases, the target color coordinates are some function of the current sensed color coordinates and/or previously stored color coordinates.

In the subprocess of FIG. 7, in step 701, a processor gets previously stored color coordinates XY_PAST(x, y) and in step 702, gets current sensed color coordinate values XY_CURRENT(x, y). Both sets of color coordinate values might be obtained by reading RAM 410 (shown in FIG. 4). The current sensed color coordinate values XY_CURRENT (x, y) might have been calculated and stored as part of step 104 in the process of FIG. 1. The previously stored color coordinate values XY_PAST(x, y) might be obtained by copying the values XY_CURRENT(x, y) prior to those values XY_CURRENT(x, y) being updated based on a new reading of the CALS.

Calculating the current sensed color coordinate values XY_CURRENT(x, y) from the RGB values obtained from the CALS and stored values can be done as explained below. First, the RGB values obtained from the CALS and the variable array (Rk, Gk, Bk), and the matrix RGB2XYZ[ ] are used to calculate a set of values labelled (X, Y, Z) according to Equation 5.

$$\begin{bmatrix} X \\ Y \\ Z \end{bmatrix} = RGB2XYZ[\,] * \left( \begin{bmatrix} R \\ G \\ B \end{bmatrix} - \begin{bmatrix} Rk \\ Gk \\ Bk \end{bmatrix} \right) \quad \text{(Eqn. 5)}$$

From the set of values labelled (X, Y, Z) values, a color value (x, y) in an "xyY" color space can be calculated using standard techniques, as shown by Equations 6 and 7. The "Y" value from the set of values labelled (X, Y, Z) can be used as an input to an auto-brightness control as explained above with reference to steps 105 and 106 in FIG. 1. In other variations, nonlinear mappings might be used instead of matrix multiplication.

$$x = X/(X+Y+Z) \quad \text{(Eqn. 6)}$$

$$y = Y/(X+Y+Z) \quad \text{(Eqn. 7)}$$

The previously stored color coordinate values XY_PAST (x, y) might be the values that were the current sensed color coordinate values just prior to the update of those current sensed color coordinate values based on new CALS readings. Since both the sets of color coordinate values are available, the difference can be easily determined. In some implementations, the white point is updated every time there is a new reading, but that is often not necessary. In the process illustrated in FIG. 7, in step 703, the processor determines whether XY_CURRENT(x, y) differs from values XY_PAST(x, y) enough to justify an update to a white point. If it does not, then the processor returns without making a change.

One method for deciding whether there is enough of a difference to justify an update is to calculate a value Δxy representing a color space distance between the previously stored color coordinate values and the current sensed color coordinate values, as illustrated in Equation 8. In Equation 8, PAST(x) and PAST(y) are the values of XY_PAST(x, y) respectively and CURRENT(x) and CURRENT(y) are the values of XY_CURRENT(x, y) respectively.

$$\Delta xy = \sqrt{(\mathrm{PAST}(x) - \mathrm{CURRENT}(x))^2 + (\mathrm{PAST}(y) - \mathrm{CURRENT}(y))^2} \quad \text{(Eqn. 8)}$$

In a basic implementation, Δxy is compared to a threshold color space distance and, if the Δxy is greater than the threshold color space distance, the white point is updated, otherwise it is not. This step of not always updating might be useful to avoid having to deal with minor changes constantly. An example threshold color space distance might be a predetermined threshold color space distance of 0.015. Another possible predetermined color space distance is 0.005. Since the sensed color coordinate values are unitless, the threshold color space distance is also unitless. The particular threshold color space distance used might be a changeable parameter that can be adjusted as part of a product design based on consumer experience and feedback. For example, if testing shows that white point adjustment is too sensitive to frequent, small changes in ambient light, the threshold color space distance might be higher, whereas is testing shows that the white point adjustment is not sensitive enough to changes, the threshold color space distance might be lower.

In step 704, the processor determines whether XY_CURRENT(x, y) would be within a region of interest ("ROI"). An example of a process for determining region of interest is described further below. Generally, a region of interest is a region of the color space and if XY_CURRENT(x, y) is outside the region of interest, the processor does not perform white point adjustment. This is useful where the ambient light is far from any white point. This way, if the device is placed in a room with pure red light, the processor does not attempt to color correct so that a display background appears to be white to a viewer. If the processor determines that XY_CURRENT(x, y) is not within the region of interest, the processor returns. Where the subprocess of FIG. 7 is part of step 109 in the process of FIG. 1, the processor might return and loop back to step 101 in FIG. 1.

Step 705 is reached when XY_CURRENT(x, y) is within the region of interest and Δxy is greater than the threshold color space distance. In step 705, the processor determines a step count. The step count represents the number of steps that a white point adjustment is spread over. If the step count is 1, then the white point adjustment happens all at once. If the step count is greater than one, the white point adjustment happens over that many steps. The timing between steps might be one loop period or a step period might be different than a loop period. In examples described herein, the step period is 200 milliseconds. With that step period, a white point adjustment that is to be done over 30 steps would occur in a time span of around 6 seconds.

Using a step count of greater than one allows for the white point to change a small amount in each of a series of steps rather than all at once. This will smooth transitions of the white point where there are sudden and large changes in ambient lighting. The processor might be programmed to make a change in one step when Δxy is less than some maximum single step amount and make a change in multiple steps when Δxy is equal to or more than some maximum single step amount.

The number of steps might be a function of the size of the change in the ambient color, with more steps being used for larger changes in the ambient color. If the number of steps is proportional to the size of the change, that might provide smoothness of the white point change as a function of ambient lux. Appendix A provides an example of program code that might be used to transition from a current white point to a target white point in STEPS number of steps. More specifically, the program code provides for a transition of current color coordinates from the color coordinates in a color space of at least two dimensions into target color coordinates in that color space. In that example, there is a parameter, ALPHA, that might be a changeable parameter that would result in different responses to step-wise white point changes. Those uses are described in more detail below.

It may be that the number of steps for a given size of change in the ambient color is a user settable parameter. To provide a more intuitive setting, the user might be provided with a slider bar in a user interface to input a setting that varies from "fast ambient light response" to "slow ambient light response" and the device might use that setting to vary a stored parameter that determines a maximum allowed transition in white point, e.g., a maximum single step amount, per step period. As one example, the maximum single step amount might be set to 5% of the total extent of white point changes so that a white point adjustment can span from 1 to 20 step periods if the Δxy value is large enough.

In step 706, the color correction matrix is calculated and provided to the display framework. From there, the processor returns from the subprocess. Details of one example of calculating the color correction matrix for a target white point is shown in Appendix B. As illustrated there, the color correction matrix for the target white point can be computed from value of the white point, expressed by the values XY_CURRENT(x, y) and various device-dependent values, which might be computed ahead of time.

Providing the color correction matrix to the display framework might comprise providing a color calibration matrix to a color calibration block of a color management system of a system on a chip. For example, suppose the device has a display framework that performs the following arithmetic:

$$Rout = a11*Rin + a21*Gin + a31*Bin$$

$$Gout = a12*Rin + a22*Gin + a32*Bin$$

$$Bout = a13*Rin + a23*Gin + a33*Bin$$

If that is the case, then the processor can provide the display framework with the color correction matrix to be used as the aij values in the above arithmetic. For other systems on a chip or other display frameworks, the approach might be different depending on how such systems provide for color calibration.

Figure 8:
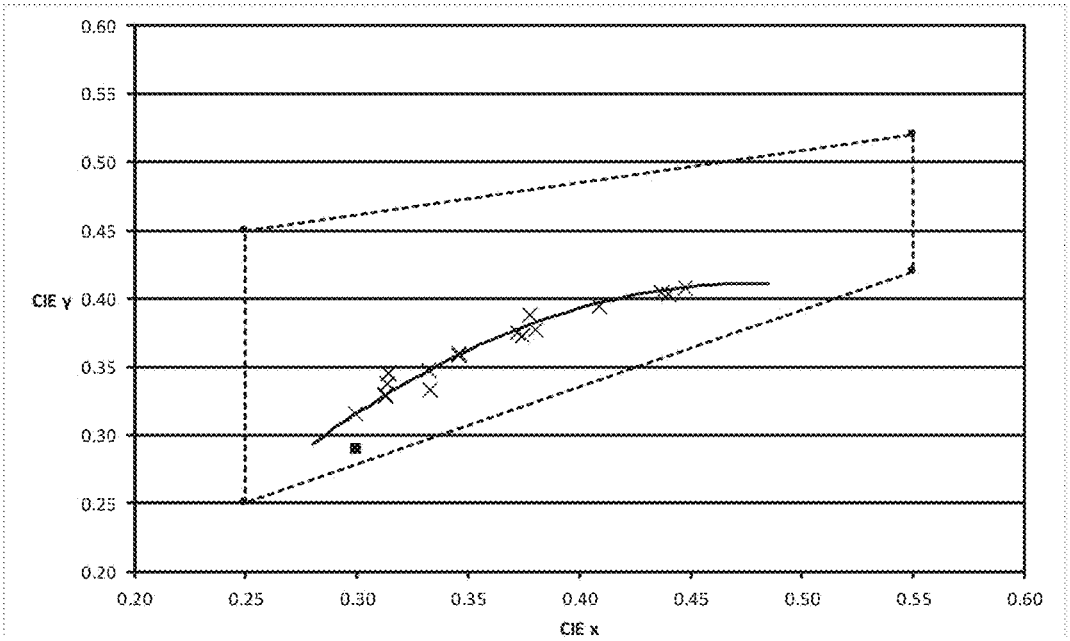
FIG. 8 is a plot showing bounds of a range of interest ("ROI") for dynamic color correction.

FIG. 8 is a plot showing bounds of a region of interest ("ROI") for dynamic color adjustment. Appendix C illustrates example code for determining whether a color point is in that ROI. As explained above, using a region of interest to filter whether to do a white point adjustment skips the white point adjustment for ambient light that is too far away from white light or other light colors to do white point adjustment. In a simple case, the region of interest is defined by a quadrilateral in the CIE (x, y) color space and so determining whether a color value (x, y) is within that region of interest is a simple matter of calculating whether that color value's coordinates fall within the quadrilateral. This is illustrated in FIG. 8. The particular vertices used for forming the ROI might be a design choice.

The ROI might be specified by parameters stored in memory at the device, so that they can be easily modified. FIG. 8 shows a region of interest comprising the quadrilateral defined by the vertices (0.25, 0.25), (0.25, 0.45), (0.55, 0.52), and (0.55, 0.42). These might be stored in memory as the parameters roi_x1, roi_x2, roi_x3, roi_x4, roi_y1, roi_y2, roi_y3, and roi_y4, or vertx [0] to vertx [3] and verty [0] to verty [3]. Thus, if the WPA process reads the CALS and measures a color point inside the ROI, WPA is applied to correct the white point of the display and, if outside the ROI, no adjustments are made, as explained above with reference to step 704 in FIG. 7. In the example of FIG. 8, the measured color point indicated by the black square is inside the ROI, so it would be adjusted (if other conditions, such as whether adjustment is turned on or not).

In general, where the region of interest is represented as a polygon, the region of interest parameters can be specified by the vertices of such a polygon. In other instances, a curved region of interest might be used and such a curved region of interest might also be specified by parameters that would define a bounding curve.

In the above examples, there is a previous white point and a current white point. If those two points are allowed to be anywhere in the CIE (x, y) color space, that might result in a color cast on the white point. As explained below, the previous white point and a current white point might be projected onto an illuminants curve and adjustments made from the projected points instead of the measured points. Note that the previous white point might be the result of an actual measured light color or might be a default or initialized value. Projected current color coordinates might be stored in memory as projected current color coordinates and projected previously stored color coordinates might be stored in memory as projected previously stored color coordinates, for use in calculations.

Figure 9:
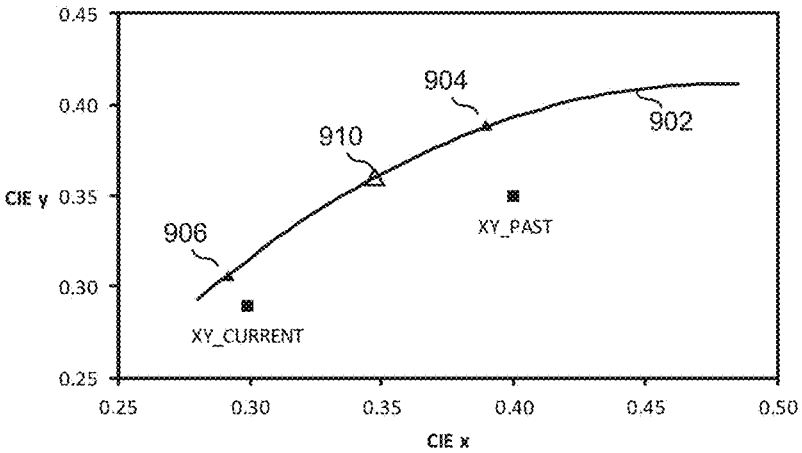
FIG. 9 is a plot showing projections onto an illuminants curve and partial adjustment.

FIG. 9 is a plot showing projections onto an illuminants curve 902 and partial adjustment. In this example, the illuminants curve is the CIE daylight locus. When the processor obtains a reading from the CALS and performs the conversion into the CIE color space to arrive at XY_CURRENT, it might then project that value onto the illuminants curve and then use that value instead of the actual measured value. The illuminants curve might be represented in a device by a set of illuminants curve parameters, such as the values (3.0, 2.87, 0.275).

In FIG. 9, the point XY_PAST represents XY_PAST(x, y), a previously stored color coordinate value and the point XY_CURRENT represents XY_CURRENT(x, y), a current obtained color coordinate value to be used to determine white point adjustment. In the case of XY_PAST, it is projected to point 904, and in the case of XY_CURRENT, it is projected to point 906. Code might be provided to a processor to compute a projection of a point if there is a solution to an intersection equation, such as that illustrated by the following:

xe=0.332; ye=0.1858; // xe and ye are the coordinates of the equi-energy point m=(y−ye)/(x−xe); // x and y are the coordinates of the point to be projected; m is slope c0=−m*xe+ye;

a=3.0; b=m−2.87; c=c0+0.275; // a, b, and c are coefficients of the illuminants curve det=b*b−4*a*c; // det is the determinant of the quadratic equation using a, b, and c Using the above values, if det is less than zero, there is no real solution, and thus no suitable intersection is available. In that case, the code might direct the processor to default to a fixed white point, such as the white point D65 having coordinates approximated by x=0.313 and y=0.329. If det is equal to zero, the code can direct the processor to use x=−b/2a and y=mx+c0. If det is greater than zero, there are two possible solutions as illustrated by Equations 9 and 10 and the processor can select one of the two possible solutions. Where one of the solutions is within the ROI and the other is not, the solution within the ROI might be preferred.

$$x = \frac{\left(-b \pm \sqrt{b^2 - 4ac}\right)}{2a} \quad \text{(Eqn. 9)}$$

$$y = mx + c0 \quad \text{(Eqn. 10)}$$

In some cases, instead of moving all the way from the previous color coordinate value to the current color coordinate value, the code can direct the processor to move only part of the way. In FIG. 9, this is illustrated by point 910, which is part of the way between point 904 and point 906. This partial movement can be useful in low lux environments. In the program code of Appendix A, there is a variable, ALPHA, used in some of the program steps. This is a factor or weight used to specify the amount of adjustment to perform. In these examples, ALPHA ranges from 0.0 to 1.0. ALPHA=0.0 would correspond to no change, similar to what happens with white points that are outside the region of interest, while ALPHA=1.0 would correspond to a full change, from the previously stored color coordinate values to the current color coordinate values.

The value of ALPHA might be dependent on the amount of light sensed by the CALS and that dependency might be parameterized. For example, stored parameters might include alpha_main_scale, slope, fifty_pct_pt, and mid_pt, where alpha_main_scale is an extra scale factor used to adjust for the maximum amount of adjustment desired, slope is a rate of ALPHA function change, fifty_pct_pt is a lux level at which the value of ALPHA will be 50% of alpha_main_scale, and mid_pt is the midpoint of the lux level at which WPA is applied. Example values might be alpha_main_scale=0.9, slope=25.0, fifty_pct_pt=150.0, and mid_pt=700.0. Example code for setting ALPHA might be as follows:

asymptote = 6.9) // 6.9 corresponds to ln(1/((1/0.999)−1)), a useful asymptote

-continued

```
if (Y>= 2*mid_pt− fifty_pct_pt− slope*asymptote)
    use the fixed white point
else if (Y<=mid_pt)
    ALPHA = alpha_main_scale *
      ABS(1/(1+EXP(−(Y−1 fifty_pct_pt)/slope)))
  else
    ALPHA = (1−alpha_main_scale) *
      ABS(1/(1+EXP(−(Y−fifty_pct_pt−mid_pt)/slope)))
        + (alpha_main_scale)
  end
```

Tuning WPA Parameters

In some implementations, some parameters used by the WPA process can be tuned. These might be stored in an editable configuration file and/or be configurable through a host of APIs in run time. Some of these parameters can be tuned at manufacture time and fixed at that point, some might be set at manufacture time, but be changeable later by a technician or an end user, some might be set by the user according to user preferences, and some might be set in software that is subsequently updated. User preferences might be obtained via a user interface of the electronic device that has the display and is performing WPA. The obtained user preferences might be stored in memory on the electronic device as user preference inputs.

Temporal parameters, that affect how processes behave as a function of time, can often be adjusted independently, such as start_steps and stop_steps, which control a rate of feathering. The parameter start_steps controls a rate of feathering-on of a WPA process and subsequent color adjustment changes to the screen while the WPA state is changed from "OFF" to "ON" (and thus performing WPA). In one example, start_steps is the number of time units (say, 200 milliseconds units) that feathering-on is spread over. In that example, start_steps=30 corresponds to feathering being spread over 30*200 ms=6 seconds. The parameter stop_steps controls the rate of feathering-off. Each step again might correspond to roughly 200 ms. Feathering-off, if used, would provide similar feathering for when the WPA state is changed from "ON" to "OFF" (and thus stopping WPA).

A parameter, threshold, controls how much of a color difference in ambient light must be observed before making a change, e.g., the value of the threshold color space distance Δxy described above. This setting might be based on how particular sensors and cover glasses perform and various calibration variations taken into consideration, so it can be useful to have this as a changeable parameter rather than a fixed value. This parameter might be set at the factory for all devices of one type on a production line based on a representative sample, or it might be set in consideration of how much computing power is available to perform the necessary calculations. The parameter might also have a temporal component, such as a setting that the white point is changed at least as often as each X time units even if the threshold color space distance has not sufficiently changed. For example, if the ambient light signal has not changed by more than 0.015 in any time period, after 60 seconds, perform an update anyway. There are also parameters, as explained above, that can define a region of interest.

Other parameters are considered "strength" parameters that alter how strong some effect might be. In testing to determine the appropriate and/or visually appealing strength parameters, the temporal parameters can be set to 1.0 so that effects of changes to the strength parameters are viewable right away. This allows a quick assessment of the final "steady-state" color, independent of the temporal settings. Parameter tuning can be performed using multiple intensities of ambient light. For example, parameter settings might be checked under morning light, afternoon light, night lighting indoors, and outdoor light settings, etc.

The adjustable parameters might include an adjustable parameter for a maximum color correction, an adjustable parameter for a midpoint, an adjustable parameter for a midweight value, and an adjustable parameter for a slope of color correction change. In the examples shown, the adjustable parameter for a maximum color correction is represented by the variable alpha_main_scale and controls the amount of overall correction to be applied, where alpha_main_scale=0.0 causes the WPA process to make no changes based on ambient light and alpha_main_sc al e=1.0 allows the WPA process to change the white point all the way to the CALS's estimate of the color of the ambient light for lux values around a midpoint of the lux level. Values of alpha_main_scale around 0.5 to 0.75 might work well. When alpha_main_scale is zero, the white point might just be set at a nominal white point, such as the color with a CIE 1931 2° color value of (0.313, 0.329) or F7 in the chart of FIG. 2.

In the examples shown, the adjustable parameter for slope of color correction change (e.g., rate of change of ALPHA) is represented by the variable s lope, the adjustable parameter for the midpoint is represented by the variable mid_pt (the midpoint of the lux level at which color correction is applied), and the adjustable parameter for the midweight value is represented by the variable fifty_pct_pt (a lux level at which the value of ALPHA will be 50% of alpha_main_scale).

FIGS. 10-13 illustrate effects on varying some of these parameters. Each of these figures illustrates various plots of the ALPHA value used for a given light intensity. In the plots shown, the horizontal axis is estimated lux and runs from 0 lux to 2000 lux (some of the plots are truncated at less than 2000 lux and the value of ALPHA might be constant over the truncated portion). The vertical axis is for the weight (ALPHA) and runs from 0.00 to 1.00, in increments of 0.10.

FIG. 10 comprises a set of plots illustrating effects on WPA of varying alpha_main_scale while keeping the parameters slope, fifty_pct_pt, and mid_pt constant. Specifically, each of the three plots of FIG. 10 are for slope=40.0, fifty_pct_pt=150.0, and mid_pt=1000, with FIG. 10(A) for alpha_main_scale=0.0, FIG. 10(B) for alpha_main_scale=0.6, and FIG. 10(C) for alpha_main_scale=1.0.

FIG. 11 comprises a set of plots illustrating effects on WPA of varying the 50% point. The fifty_pct_pt parameter is a parameter that defines an overall rate of change of ALPHA as a function of ambient light intensity, such as a lux level at which the value of ALPHA will be 50% of alpha_main_scale. Each of the three plots of FIG. 11 are for alpha_main_scale=0.6, slope=40.0, and mid_pt=1000 with FIG. 11(A) for fifty_pct_pt=1.0, FIG. 11(B) for fifty_pct_pt=150.0, and FIG. 11(C) for fifty_pct_pt=500. Note that FIG. 11(B) is the same as FIG. 10(B), as they use the same parameters.

FIG. 12 comprises a set of plots illustrating effects on WPA of varying the slope while keeping the parameters alpha_main_scale, fifty_pct_pt, and mid_pt constant. The slope parameter is another parameter that defines an overall rate of change of ALPHA as a function of ambient light intensity. Each of the three plots of FIG. 12 are for alpha_main_scale=0.6, fifty_pct_pt=150.0, and mid_pt=1000, with FIG. 12(A) for slope=1.0, FIG. 12(B) for slope=40.0, and FIG. 12(C) for slope=100.0. Note that FIG. 12(B) is the same as FIG. 10(B), as they use the same parameters.

FIG. 13 comprises a set of plots illustrating effects on WPA of varying the lux midpoint while keeping the parameters alpha_main_scale, slope, and fifty_pct_pt constant.

Specifically, each of the three plots of FIG. 13 are for alpha_main_scale=0.6, slope=40.0, and fifty_pct_pt=150.0, with FIG. 13(A) for mid_pt=500, FIG. 13(B) for mid_pt=1000, and FIG. 13(C) for mid_pt=1500. Consider mid_pt as representative of (related to) the lux beyond which no correction is to be applied. This corresponds to the step function going back down to zero in the ALPHA curves.

If the display is overcorrected in medium indoor lighting (200-600 lux), then the alpha_main_scale parameter might be too high in that setting. For moderate correction in indoor settings, the parameters might be threshold=0.005, alpha_main_scale=0.65, slope=40.0, fifty_pct_pt=150.0, and mid_pt=1200. For an aggressive correction in indoor settings, the parameters might be threshold=0.005, alpha_main_scale=0.7, slope=100.0, fifty_pct_pt=400.0, and mid_pt=1200.

Examples of devices that might use these techniques include personal computers, cell phones, handheld messaging devices, laptop computers, tablet computers, set-top boxes, personal data assistants, embedded computer systems, electronic book readers and the like. They might be connected to an intranet, the Internet, a cellular network, a local area network, a satellite network or any other such network and/or combination thereof. Components used for such a system can depend at least in part upon the type of network and/or environment selected. Protocols and components for communicating via such a network are well known and will not be discussed herein in detail. Communication over the network can be enabled by wired or wireless connections and combinations thereof.

The various embodiments further can be implemented in a wide variety of operating environments, which in some cases can include one or more user computers, computing devices or processing devices which can be used to operate any of a number of applications. User or client devices can include any of a number of general purpose personal computers, such as desktop, laptop or tablet computers running a standard operating system, as well as cellular, wireless and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems and other devices capable of communicating via a network. These devices also can include virtual devices such as virtual machines, hypervisors and other virtual devices capable of communicating via a network.

Various embodiments of the present disclosure utilize at least one network that would be familiar to those skilled in the art for supporting communications using any of a variety of commercially-available protocols, such as Transmission Control Protocol/Internet Protocol ("TCP/IP"), User Datagram Protocol ("UDP"), protocols operating in various layers of the Open System Interconnection ("OSI") model, File Transfer Protocol ("FTP"), Universal Plug and Play ("UpnP"), Network File System ("NFS"), Common Internet File System ("CIFS") and AppleTalk. The network can be, for example, a local area network, a wide-area network, a virtual private network, the Internet, an intranet, an extranet, a public switched telephone network, an infrared network, a wireless network, a satellite network and any combination thereof.

Such devices also can include a computer-readable storage media reader, a communications device (e.g., a modem, a network card (wireless or wired), an infrared communication device, etc.) and working memory as described above. The computer-readable storage media reader can be connected with, or configured to receive, a computer-readable storage medium, representing remote, local, fixed and/or removable storage devices as well as storage media for temporarily and/or more permanently containing, storing, transmitting and retrieving computer-readable information. The system and various devices also typically will include a number of software applications, modules, services or other elements located within at least one working memory device, including an operating system and application programs, such as a client application or web browser. It should be appreciated that alternate embodiments may have numerous variations from that described above. For example, customized hardware might also be used and/or particular elements might be implemented in hardware, software (including portable software, such as applets) or both. Further, connection to other computing devices such as network input/output devices may be employed.

Storage media and computer readable media for containing code, or portions of code, can include any appropriate media known or used in the art, including storage media and communication media, such as, but not limited to, volatile and non-volatile, removable and non-removable media implemented in any method or technology for storage and/or transmission of information such as computer readable instructions, data structures, program modules or other data, including RAM, ROM, Electrically Erasable Programmable Read-Only Memory ("EEPROM"), flash memory or other memory technology, Compact Disc Read-Only Memory ("CD-ROM"), digital versatile disk (DVD) or other optical storage, magnetic cassettes, magnetic tape, magnetic disk storage or other magnetic storage devices or any other medium which can be used to store the desired information and which can be accessed by the system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including" and "containing" are to be construed as open-ended terms (i.e., meaning "including, but not limited to,") unless otherwise noted. The term "connected," when unmodified and referring to physical connections, is to be construed as partly or wholly contained within, attached to or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," unless specifically stated otherwise or otherwise clearly contradicted by context, is otherwise understood with the context as used in general to present that an item, term, etc., may be either A or B or C, or any nonempty subset of the set of A and B and C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present.

Operations of processes described herein can be performed in any suitable order unless otherwise indicated herein or otherwise clearly contradicted by context. Processes described herein (or variations and/or combinations thereof) may be performed under the control of one or more computer systems configured with executable instructions and may be implemented as code (e.g., executable instructions, one or more computer programs or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory.

The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described herein, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described herein. Accordingly, the scope of the present disclosure includes all modifications and equivalents of the subject matter recited in the claims appended hereto as permitted by applicable law. Moreover, any combination of the above-described elements in all possible variations thereof is encompassed by the scope of the present disclosure unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

Appendix A

// This routine calculates a color correction matrix in steps.

// The routine starts at a current color value (*xW_Current*, *yW_Current*) and ends at a
// target color value (*xW_Target*, *yW_Target) in* STEPS steps, each time calculating
// a new color correction matrix and outputting that to the display framework.

// When first run or initialized, initialize *xW_Current* = 0.313, *yW_Current* = 0.329
// $x$ = 0.313, $y$ = 0.329 are the CIE coordinates for the default white point used here.
// However, other default white points are possible

*xW_Target* = 0.313 – ALPHA*(0.313- $x_1$)
*yW_Target* = 0.329 – ALPHA*(0.329- $y_1$)

For stepCount = 1 to STEPS
    *xW_t* = *xW_Current* – stepCount*(*xW_Current* – *xW_Target*)/STEPS
    *yW_t* = *yW_Current* – stepCount*(*yW_Current* – *yW_Target*)/STEPS
    CALC_COLOR_CORRECTION_MATRIX(*xW_t, yW_t*)
End
Update *xW_Current* = *xW_t*; *yW_Current* = *yW_t*;

Appendix B

This Appendix describes how to calculate a color correction matrix for a color value ($x$, $y$). This calculation might be used for CALC_COLOR_CORRECTION_MATRIX($x$, $y$) in the code of Appendix A as well as other places. The steps are as follows:

1. Read in a previously calculated color space transform matrix A (this might be a factory setting). The superscript -1 denotes a matrix inverse operation and the matrix $\mathbf{A}^{-1}$ might be calculated ahead of time. An example of the matrix $\mathbf{A}^{-1}$ is:

$$\mathbf{A}^{-1} = \begin{bmatrix} 3.197213032367973 & -1.510793781942079 & -0.487923253833050 \\ -0.968865784759543 & 1.894829038629370 & 0.024738091957191 \\ 0.082571786006733 & -0.239214220726049 & 1.066638294968611 \end{bmatrix}.$$

2. Compute non-normalized color correction coefficients $sR$, $sG$, $sB$ for the input color value, using the following formula:

$$\begin{bmatrix} sR \\ sG \\ sB \end{bmatrix} = \mathbf{A}^{-1} \begin{bmatrix} x/y \\ 1 \\ (1-x-y)/y \end{bmatrix}$$

3. Compute color normalized coefficients $sRnorm$, $sGnorm$, $sBnorm$ using the following formulas, which normalizes the coefficients to being between 0 and 1:

if ($sR < 0$), $sR = 0$
if ($sG < 0$), $sG = 0$
if ($sB < 0$), $sB = 0$
$sRnorm = sR / \max(sR, sG, sB)$
$sGnorm = sG / \max(sR, sG, sB)$
$sBnorm = sB / \max(sR, sG, sB)$ 4. Set the values of the 3x3 color calibration matrix (the values provided to the color calibration block of the application processor or display framework) to the following:

$a11 = (sRnorm)$^(1/2.2)
$a22 = (sGnorm)$^(1/2.2)
$a33 = (sBnorm)$^(1/2.2)
$a21 = a31 = a12 = a32 = a13 = a23 = 0$ In the above equations of Step 4, the exponent (1/2.2) corresponds to an approximation of a transfer function of the display. Other values might be used instead. In the above equations of Step 4, the nondiagonal elements of the color calibration matrix are zero. Nonzero values might be used, if desired, although that might alter the true primaries.

Appendix C

```
int pointInROI(float testx, float testy)
{
	int i, j, c = 0;
	float vertx[4]; verty[4];
	int nvert = 4;
	vertx[0] = 0.25;	verty[0] = 0.25;
	vertx[1] = 0.25;	verty[1] = 0.45;
	vertx[2] = 0.55;	verty[2] = 0.52;
	vertx[3] = 0.55;	verty[3] = 0.42;

	for (i = 0, j = nvert-1; i < nvert; j = i++)
	{
		if ( ((verty[i]>testy) != (verty[j]>testy)) && (testx < (vertx[j]-vertx[i]) *
(testy-verty[i]) / (verty[j]-verty[i]) + vertx[i]) )
		{
			c = !c;
		}
	}
return c;
}
```

What is claimed is:

1. A method for adjusting an emissive color display of an electronic device having a processor and a memory, and the electronic device configured with executable instructions executable by the processor to control pixel colors of pixels of the emissive color display to form a display image viewable on the emissive color display, the method comprising:

sensing a color of ambient light at the electronic device using a color ambient light sensor;

converting signals from the color ambient light sensor into current sensed color coordinates in a color space, wherein the color space is at least two dimensions with coordinates in the color space corresponding to colors;

obtaining previously stored color coordinates that comprise default color coordinate values or sensed color coordinates from a prior adjustment performed by the electronic device;

comparing the current sensed color coordinates to the previously stored color coordinates;

determining if the current sensed color coordinates vary from the previously stored color coordinates by a predetermined threshold color space distance;

determining a region of interest of the color space, wherein the region of interest defines a subset of possible color coordinates of the color space within which white point adjustment of the emissive color display is to be done; and if the current sensed color coordinates vary from the previously stored color coordinates by the predetermined threshold color space distance and the current sensed color coordinates are within the region of interest:

a) computing, from the current sensed color coordinates, target color coordinates for an adjusted white point that accounts for the color of the ambient light; and b) computing a color calibration matrix that maps color values provided by programs executing on the electronic device to pixel color values sent to the emissive color display, wherein the color calibration matrix is computed as a function of the target color coordinates to have a white point of the emissive color display correspond to the target color coordinates.

2. The method of claim 1, further comprising:

determining whether the target color coordinates vary from the previously stored color coordinates by more than a maximum single step amount; and if the target color coordinates vary from the previously stored color coordinates by more than the maximum single step amount, adjusting the white point from the previously stored color coordinates to the target color coordinates over a plurality of adjustment periods.

3. The method of claim 1, further comprising:

retrieving illuminants curve parameters defining an illuminants curve in the color space;

projecting the current sensed color coordinates onto a projected point on the illuminants curve; and use the projected point as the target color coordinates for adjustment of the adjusted white point.

4. The method of claim 1, further comprising:

retrieving a maximum single step amount that defines a maximum step change of white point that is allowed to occur in a step period; and adjusting the target color coordinates over a plurality of adjustment periods when the target color coordinates would otherwise vary from the previously stored color coordinates by more than the maximum single step amount.

5. The method of claim 1, further comprising:

retrieving a weight value that is a function of a lux value of the current sensed color coordinates;

determining an adjustment from the previously stored color coordinates to the target color coordinates based on a proportion of the weight value and a color space distance from the previously stored color coordinates to the current sensed color coordinates; and adjusting the target color coordinates using adjustment.

6. The method of claim 5, wherein the adjustment further depends on adjustable parameters for a maximum color correction, a midpoint, a midweight value, and a slope of color correction change.

7. The method of claim 5, wherein the weight value is a function of user preference inputs.

8. The method of claim 1, further comprising:

reading from a color ambient light sensor ("CALS") to obtain signals including a brightness component value;

calculating an auto-brightness level from the brightness component value; and providing the auto-brightness level to a display framework of the electronic device for the display framework to use in adjusting an overall brightness level of the electronic device, wherein providing the auto-brightness level to the display framework comprises storing a variable duty cycle value of power applied to a backlight of the electronic device.

9. A non-transitory computer-readable storage medium having stored thereon executable instructions that, when executed by one or more processors of a computer system, cause the computer system to at least:

obtain color signals representing a color of ambient light impinging on a color ambient light sensor of an electronic device that has an emissive color display;

convert the color signals into current sensed color coordinates in a color space, wherein the color space is at least two dimensions with coordinates in the color space corresponding to colors;

obtain previously stored color coordinates that comprise default color coordinate values or sensed color coordinates from a prior adjustment period;

obtain illuminants curve parameters defining an illuminants curve in the color space;

project the current sensed color coordinates onto a projected point on the illuminants curve;

compute, from the projected point, the current sensed color coordinates and the previously stored color coordinates, target color coordinates for an adjusted white point that accounts for the color of the ambient light; and compute a color calibration matrix that would map color values to pixel color values sent to the emissive color display, wherein the color calibration matrix is computed as a function of the target color coordinates to have a white point of the emissive color display correspond to the target color coordinates.

10. The non-transitory computer-readable storage medium of claim 9, having stored thereon further executable instructions that, when executed by one or more processors of a computer system, cause the computer system to at least:

determine if the current sensed color coordinates vary from the previously stored color coordinates by a predetermined threshold color space distance; and if the current sensed color coordinates vary from the previously stored color coordinates by less than the predetermined threshold color space distance, bypass an adjustment of the adjusted white point.

11. The non-transitory computer-readable storage medium of claim 9, having stored thereon further executable instructions that, when executed by one or more processors of a computer system, cause the computer system to at least:

determine a region of interest of the color space, wherein the region of interest defines a subset of the color space within which white point adjustment of the emissive color display is to be done; and if the current sensed color coordinates are outside the region of interest, bypass an adjustment of the adjusted white point.

12. The non-transitory computer-readable storage medium of claim 9, having stored thereon further executable instructions that, when executed by one or more processors of a computer system, cause the computer system to at least:

calculate projected previously stored color coordinates from the previously stored color coordinates and the illuminants curve; and wherein computing the target color coordinates uses the projected point and the projected previously stored color coordinates.

13. The non-transitory computer-readable storage medium of claim 9, having stored thereon further executable instructions that, when executed by one or more processors of a computer system, cause the computer system to at least:

determine whether the target color coordinates vary from the previously stored color coordinates by more than a maximum single step amount; and if the target color coordinates vary from the previously stored color coordinates by more than the maximum single step amount, adjust the target color coordinates over a plurality of adjustment periods.

14. The non-transitory computer-readable storage medium of claim 9, having stored thereon further executable instructions that, when executed by one or more processors of a computer system, cause the computer system to at least:

determine a weight value that is a function of a lux value of the current sensed color coordinates; and adjust the target color coordinates using the weight value, wherein an adjustment from the previously stored color coordinates to the target color coordinates is in proportion to the weight value and a color space distance from the previously stored color coordinates to the current sensed color coordinates.

15. The non-transitory computer-readable storage medium of claim 14, wherein the weight value is also a function of adjustable parameters including at least a maximum color correction, a midpoint, a midweight value, and a slope of color correction change.

16. The non-transitory computer-readable storage medium of claim 14, wherein the weight value is also a function of user preference inputs.

17. The non-transitory computer-readable storage medium of claim 9, wherein the color signals representative of the color of the ambient light impinging on the color ambient light sensor comprise a red (R) signal, a green (G) signal, and a blue (B) signal to provide an RGB color signal.

18. The non-transitory computer-readable storage medium of claim 9, having stored thereon further executable instructions that, when executed by one or more processors of a computer system, cause the computer system to at least:

read from a color ambient light sensor ("CALS") to obtain the color signals;

map the color signals to converted color signals corresponding to a second color space having one dimension corresponding to brightness and two dimensions corresponding to colors, with the converted color signals including a brightness component value;

calculate an auto-brightness level from the brightness component value; and provide the auto-brightness level to a display framework of the electronic device for the display framework to use in adjusting an overall brightness level of the electronic device.

19. The non-transitory computer-readable storage medium of claim 18, wherein providing the brightness component value to the display framework comprises storing a variable duty cycle value of power applied to a backlight of the electronic device.

20. A method for adjusting an emissive color display of an electronic device having a processor and a memory, and the electronic device configured with executable instructions executable by the processor to control pixel colors of pixels of the emissive color display to form a display image viewable on the emissive color display, the method comprising:

retrieving preset parameters that are values derived from manufacturing or operating characteristics of a representative set of devices;

retrieving individual device parameters that are values derived from manufacturing or operating characteristics of the electronic device of which the processor is a part;

obtaining color signals representing a color of ambient light impinging on a color ambient light sensor of an electronic device that has an emissive color display;

converting the color signals into current sensed color coordinates in a color space, wherein the color space is at least two dimensions;

obtaining previously stored color coordinates that comprise default color coordinate values or sensed color coordinates from a prior adjustment period;

computing, from the current sensed color coordinates and the previously stored color coordinates, target color coordinates for an adjusted white point that accounts for the color of the ambient light; and computing a color calibration matrix using the preset parameters and the individual device parameters in computing the color calibration matrix, wherein the color calibration matrix would map color values to pixel color values sent to the emissive color display, wherein the color calibration matrix is computed as a function of the target color coordinates to have a white point of the emissive color display correspond to the target color coordinates.

* * * * *